US006375372B1

(12) United States Patent
Tsau

(10) Patent No.: US 6,375,372 B1
(45) Date of Patent: Apr. 23, 2002

(54) PUSHBUTTON STRUCTURE OF KEYBOARD THAT GENERATES PULSE-LIKE REACTION WHEN DEPRESSED

(75) Inventor: Yong Te Tsau, Taipei (TW)

(73) Assignee: Behavior Tech Computer Corporation, Taipei (TW)

( * ) Notice: Subject to any disclaimer, the term of this patent is extended or adjusted under 35 U.S.C. 154(b) by 0 days.

(21) Appl. No.: 09/781,260

(22) Filed: Feb. 13, 2001

(51) Int. Cl.[7] ..... B41J 5/14; B41J 5/26
(52) U.S. Cl. ..... 400/490; 200/345; 200/521
(58) Field of Search ..... 400/488, 490, 400/495, 495.1, 480, 481; 200/344, 345, 521

(56) References Cited

U.S. PATENT DOCUMENTS 5,562,203 A * 10/1996 Mochizuki ..... 200/345
5,735,390 A * 4/1998 Takagi et al. ..... 200/344
5,971,637 A * 10/1999 Malhi et al. ..... 400/491.2
6,257,782 B1 * 7/2001 Maruyama et al. ..... 400/495.1

FOREIGN PATENT DOCUMENTS

JP 11-345535 A * 12/1999

* cited by examiner

*Primary Examiner*—Daniel J. Colilla
(74) *Attorney, Agent, or Firm*—Rosenberg, Klein & Lee

(57) ABSTRACT

A pushbutton of a keyboard includes a cap supported on a base board by a linkage comprising first and second links pivoted together whereby the cap is movable from a released to a depressed positions when depressed. Each link has upper and lower pivots respectively connected to the cap and the base board. The links have two side bars connected between the upper and lower pivots thereof. A cross bar is connected between the side bars of the first link. A resilient arm extends from the cross bar and forms a nub on a free end thereof. A rigid arm extends from one side bar of the second link and has a wedge section having first and second surfaces forming an apex therebetween. The nub of the resilient arm is in contact engagement with the first surface when the cap is at the released position. The nub slides over the apex to reach and engage the second surface when the cap is depressed and moved to the depressed position whereby a pulse-like reaction is generated. Two spring arms extend from the base board with free ends thereof receivingly engaging recesses defined in corresponding side bars for biasing the cap toward the released position. The spring arms deform when the cap is depressed whereby the spring arms help returning the cap back to the released position when the depression is released.

10 Claims, 4 Drawing Sheets

PUSHBUTTON STRUCTURE OF KEYBOARD THAT GENERATES PULSE-LIKE REACTION WHEN DEPRESSED

FIELD OF THE INVENTION

The present invention generally relates to a keyboard, such as a computer keyboard, and in particular to a pushbutton structure of a keyboard which generates a pulse-like reaction when it is depressed for indicating the depression thereof.

BACKGROUND OF THE INVENTION

A computer keyboard includes a plurality of pushbuttons each comprising a cap accessible and depressible by a user. A conventional design of the pushbutton comprises a post, which may be hollow, extending from the cap. The post is partially received and is axially movable within a guiding bore. To ensure proper movement of the cap, the post must have a size large enough to reduce the risk of being jammed in the guiding bore. This, however, is contrary to the current trend of miniaturization in the electronic and computer industries.

Pushbuttons having caps supported by a pair of links pivotally connected to each other in a cross form are also known. This structure effectively reduces the space required by a pushbutton. A rubber member is positioned under the cap. The depression of the cap collapses the rubber member. The resiliency of the rubber member restores the cap back to its original un-depressed position. Such a restoration force provided by the rubber member, however, is generally not sufficient to effectively return the cap back to the un-depressed position.

Furthermore, the rubber member only offers a very limited reaction during the depression of the pushbutton. This may sometimes be ignored by the user when the user is depressing the pushbutton and thus making no clear indication of the depression of the pushbutton to the user.

It is thus desirable to provide a pushbutton structure which overcomes the above problems.

SUMMARY OF THE INVENTION

Accordingly, an object of the present invention is to provide a pushbutton structure which generates a pulse-like reaction during depression of the pushbutton for providing a clear indication of the depression of the pushbutton.

Another object of the present invention is to provide a pushbutton structure having a strong restoring force for returning the pushbutton from a depressed position to a released position.

To achieve the above objects, in accordance with the present invention, there is provided a pushbutton structure of a keyboard comprising a cap supported on a base board by a linkage consisting of first and second links pivoted together whereby the cap is movable from a released to a depressed positions when depressed. Each link has upper and lower pivots respectively connected to the cap and the base board. The links have two side bars connected between the upper and lower pivots thereof. A cross bar is connected between the side bars of the first link. A resilient arm extends from the cross bar and forms a nub on a free end thereof. A rigid arm extends from one side bar of the second link and has a wedge section having first and second surfaces forming an apex therebetween. The nub of the resilient arm is in contact engagement with the first surface when the cap is at the released position. The nub slides over the apex to reach and engage the second surface when the cap is depressed and moved to the depressed position whereby a pulse-like reaction is generated. Two spring arms extend from the base board with free ends thereof receivingly engaging recesses defined in corresponding side bars for biasing the cap toward the released position. The spring arms deform when the cap is depressed whereby the spring arms help returning the cap back to the released position when the depression is released.

BRIEF DESCRIPTION OF THE DRAWINGS

The present invention will be apparent to those skilled in the art by reading the following description of a preferred embodiment thereof, with reference to the attached drawings, in which.

DETAILED DESCRIPTION OF THE PREFERRED EMBODIMENT

Figure 1:
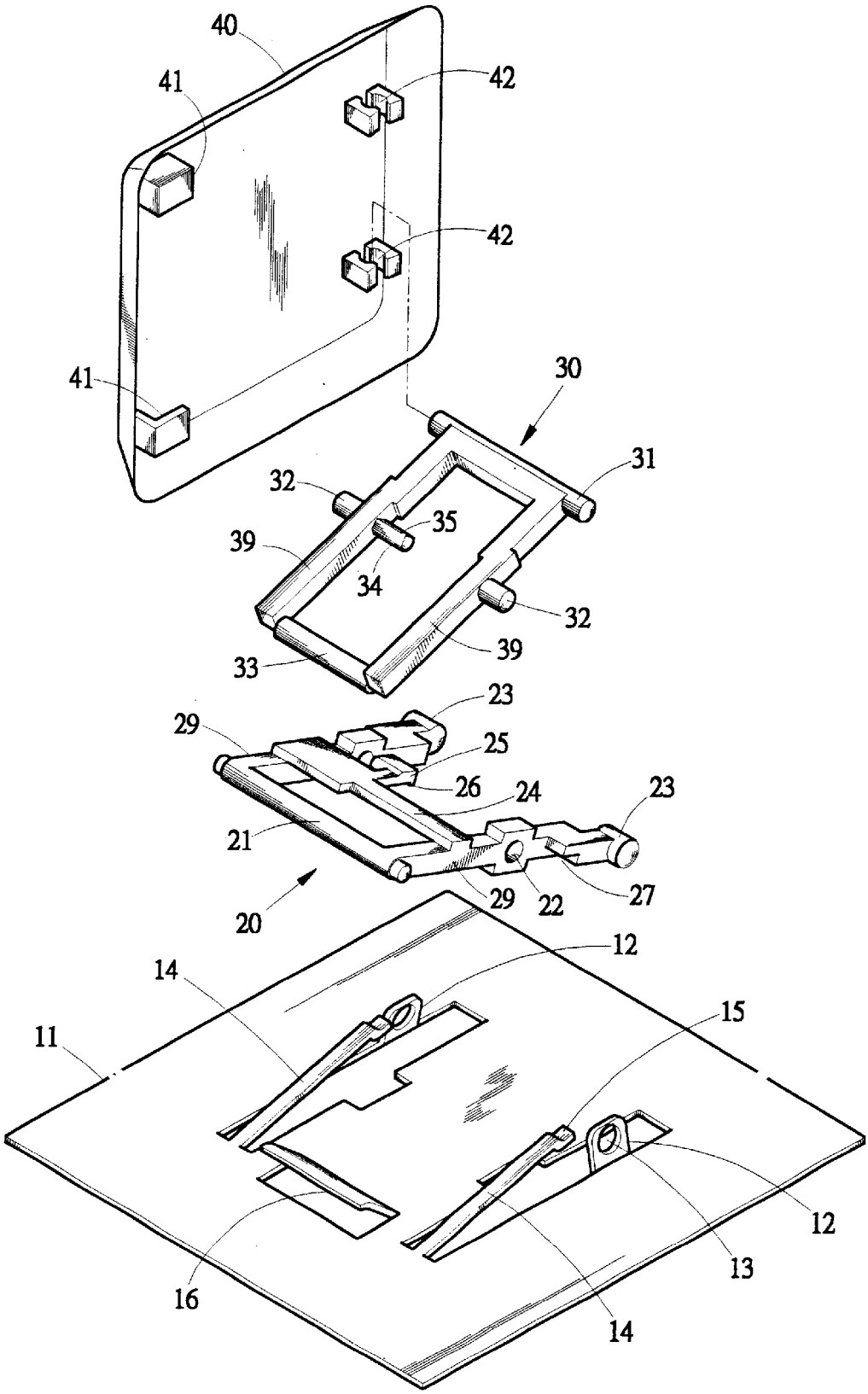
FIG. 1 is an exploded view of a pushbutton constructed in accordance with the present invention.
Figure 2:
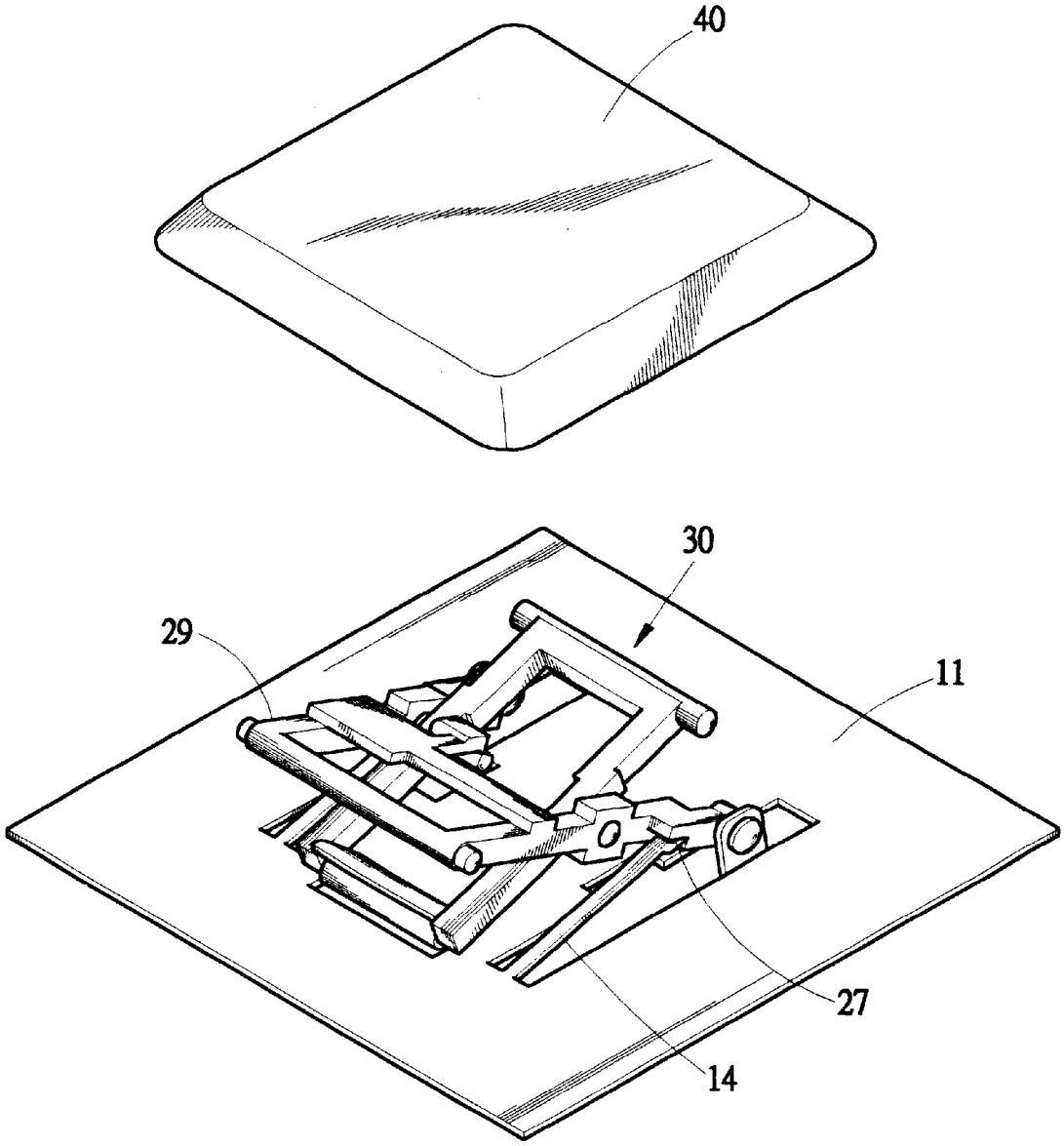
FIG. 2 is perspective view of the pushbutton of the present invention with a cap detached therefrom.

With reference to the drawings and in particular to FIGS. 1 and 2, a pushbutton constructed in accordance with the present invention, generally designated with reference numeral 10, is shown. The pushbutton 10 comprises a linkage (not labeled) consisting of first and second links 20, 30 supporting a cap 40 on a base board 11.

The base board 11 forms a pair of spaced tabs 12 substantially parallel to each other. The tabs 12 define aligned holes 13 for rotatably retaining pivot pins 23 of the first link 20 (FIG. 2). The base board 11 also forms a pair of spaced spring arms 14 each having a free end comprising an offset section 15 forming an L-shape for engaging a corresponding L-shaped recess 27 defined in the first link 20. A tab 16 is formed on the base board forming a slot for rotatably receiving and retaining a pivot pin 33 of the second link 30.

As shown in FIG. 1, the first link 20 comprises a U-shaped member (not labeled) comprising a first pivot pin 21 and two first side bars 29 extending from opposite ends of the first pivot pin 21. The first pivot pin 21 is rotatably received and retained in first pivot retaining members 41 formed on an inner surface (not labeled) of the cap 40. In the embodiment illustrated, each first pivot retaining member 41 defines a cavity for receiving a corresponding end of the first pivot pin 21. The first side bars 29 define aligned holes 22. Preferably the holes 22 are formed on substantially centers of the first side bars 29 of the first link 20 as shown in the drawings. Free ends of the first side bars 29 form axially aligned second pivot pins 23 rotatably received and retained in the holes 13 of the tabs 12 of the base board 11.

A cross bar 24, extending and connected between the first side bars 29 of the first link 20, is formed midway between the first pivot pin 21 and the holes 22. A resilient arm 25, proximate to one of the first side bars 29, extends from the cross bar 24 in a direction substantially parallel to the first side bars 29 toward the hole 22 of the adjacent first side bar 29. A nub 26 is formed on a free end of the resilient arm 25.

Each first side bar 29 defines an L-shaped recess 27 for receivingly engaging the offset section 15 of the corresponding spring arm 14 of the base board 11 for biasing and/or returning the linkage toward a released position.

The second link 30 comprises a rectangular frame (not labeled) having a third pivot pin 31 and a fourth pivot pin 33 and two second side bars 39 connected between the third and fourth pivot pins 31, 33. Opposite free ends of the third pivot pin 31 are rotatably received and retained in third pivot retaining means 42 formed on the inner surface of the cap 40. In the embodiment illustrated, the pivot retaining means 42 comprises two spaced projections (not labeled) defining a space therebetween for accommodating the corresponding free end of the third pivot pin 31. The fourth pivot pin 33 is rotatably received and retained in the slot formed by the tab 16 of the base board 11. Two axially aligned fifth pins 32 transversely extend, in opposite directions, from the second side bars 39 for being rotatably received and retained in the holes 22 whereby the first and second links 20, 30 are pivotally connected to each other, forming a cross configuration. Due to the pivotal connection between the links 20, 30, the links 20, 30 are allowed to move from the released position (FIG. 3) wherein the links 20, 30 are resiliently supported by the spring arms 14 of the base board 11 to a depressed position as shown in FIG. 4 when the pushbutton 10 is depressed.

Figure 3A:
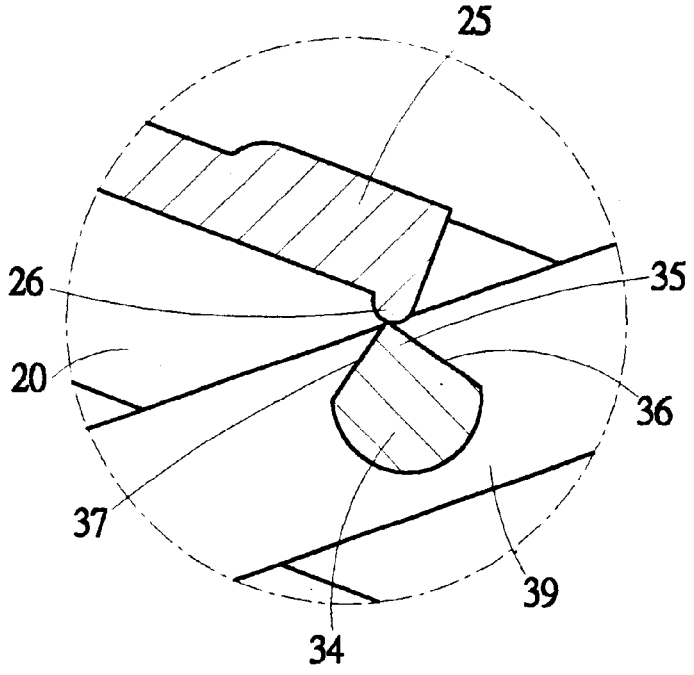
FIG. 3A is an enlarged view, in cross-sectional form, of encircled portion 3A of FIG. 3.
Figure 3:
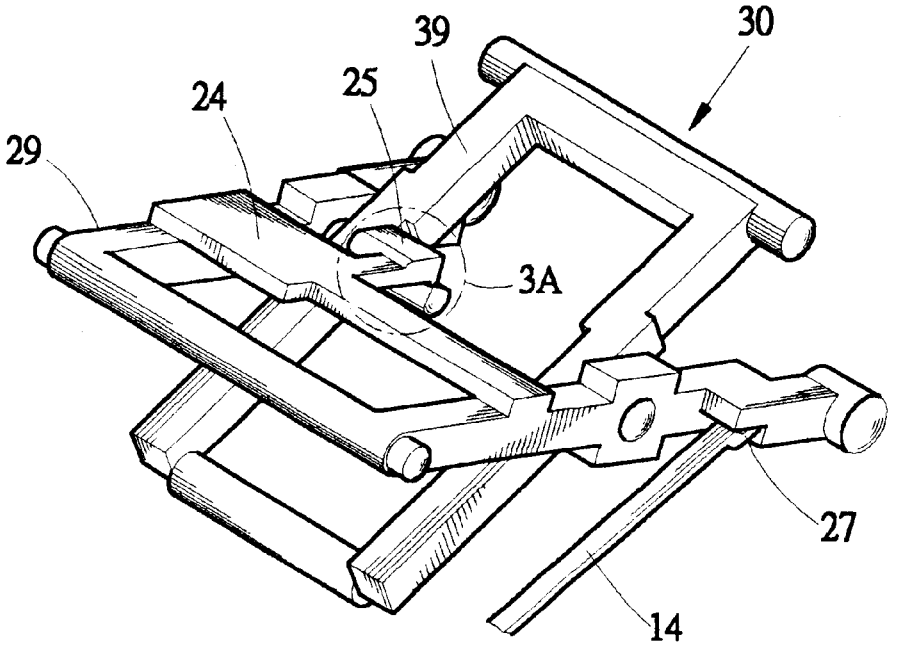
FIG. 3 is a perspective view showing a linkage of the pushbutton of the present invention in a released condition.
Figure 4A:
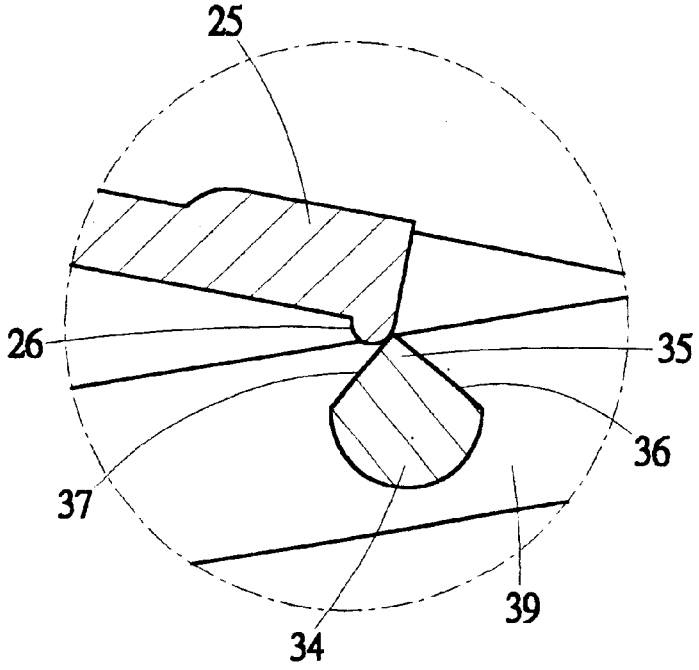
FIG. 4A is an enlarged view, in cross-sectional form, of encircled portion 4A of FIG. 4.
Figure 4:
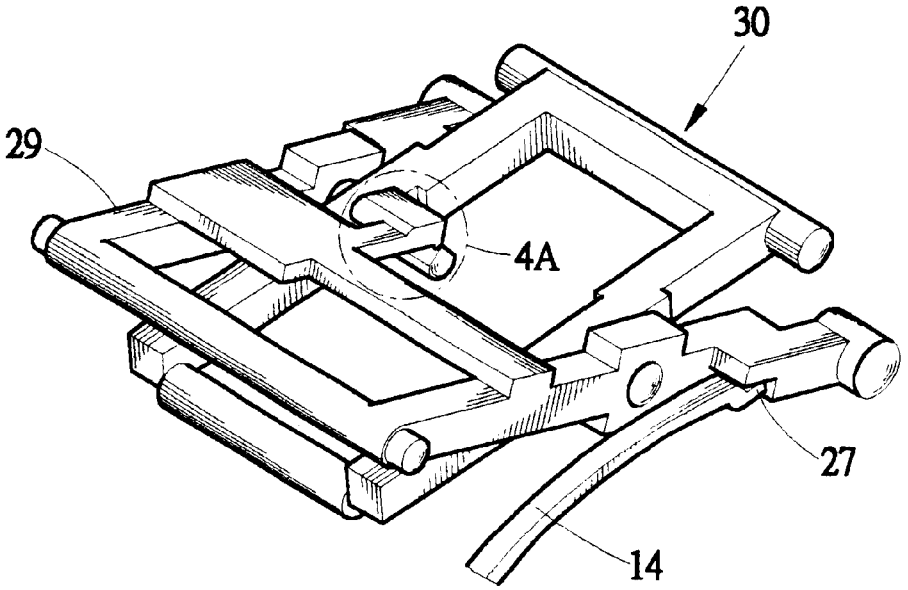
FIG. 4 is similar to FIG. 3 but showing the linkage of the pushbutton of the present invention in a depressed condition.

A rigid arm 34 extends from one of the second side bars 39 in a direction opposite to the fifth pin 32 of the second side bar 39 whereby the rigid arm 34 is in contact with the nub 26 of the resilient arm 25 of the first link 20 as shown in FIGS. 3A and 4A. The rigid arm 34 forms a wedge section 35 having first and second surfaces 36, 37 forming an apex (not labeled) therebetween. The first and second surfaces 36, 37 are arranged such that when the linkage is at the released position (FIG. 3), the nub 26 of the resilient arm 25 engages the first surface 36 as shown in FIG. 3A and when the linkage is moved to the depressed position (FIG. 4), the nub 26 slides over the apex and reaches the second surfaces 37 as shown in FIG. 4A.

To assemble, the second link 30 has a width substantially equal to or smaller than a distance between the first side bars 29 of the first link 20 whereby the second link 30 may be accommodated between the first side bars 29 of the first link 20. The fifth pins 32 of the second link 30 may then be forced into the hole 22 of the first link 20 forming the pivotal connection between the links 20, 30. The first pivot pin 21 of the first link 20 is positioned into the first pivot retaining members 41 of the cap 40. The second pivot pins 23 of the first link 20 are fit into holes 13 of the base board 11. Thereafter, the fourth pivot pin 33 of the second link 30 is placed into the slot 16 formed on the base board 11 and then the ends of the third pivot pin 31 are fit into the third pivot retaining means 42 of the cap 40. This mounts both the linkage (links 20 and 30) and the cap 40 to the base board 11. The offset sections 15 of the spring arms 14 of the base board 11 receivingly engage the recesses 27 defined in the first side bars 29 of the first link 20 thereby resiliently supporting the linkage and the cap 40 in the released position (FIG. 3). As mentioned previously, at the released position, the nub 26 of the resilient arm 25 engages the first surface 36 of the wedge 35 of the rigid arm 34 of the second link 30.

When the pushbutton is actuated by depressing the cap 40, the links 20, 30 collapse toward the base board 11 against the spring arms 14, allowing the cap 40 to move toward the base board 11. The movement of the cap 40 causes an electrical contact to change from an OFF condition to an ON condition as is similar to the conventional pushbuttons. No further detail of the contact will be given herein for it is known.

The depression of the cap 40 also causes the nub 26 to slide along the first surface 36 of the wedge 35 of the rigid arm 34 and over the apex of the wedge 35 to reach the second surface 37. The sliding of the nub 36 over the apex of the wedge 35 generates a pulse-like reaction to a user's finger depressing the pushbutton whereby a tactile sense is caused in the finger for helping the user to recognize the depression of the pushbutton.

During the depression of the cap 40, the spring arms 14 are deformed and spring energy is stored therein whereby when the pushbutton 10 is released, the stored energy drives the spring arms 14 back to their un-deformed condition thereby moving the cap 40 back to the released position when the depression of the pushbutton is released.

Although the present invention has been described with reference to the preferred embodiment thereof, it is apparent to those skilled in the art that a variety of modifications and changes may be made without departing from the scope of the present invention which is intended to be defined by the appended claims.

What is claimed is:

1. A pushbutton comprising a cap supported on a base board by a linkage, the linkage comprising first and second links pivoted to each other forming a cross configuration whereby the cap is movable with respect to the base board between first and second positions, each link having upper and lower pivots respectively connected to the cap and the base board, the first link comprising at least a first side bar connected between the upper and lower pivots of the first link, the second link comprising at least a second side bar connected between the upper and lower pivots of the second link, a first arm extending from the first side bar and forming a nub, a second arm extending from the second side bar and having first and second surfaces forming an apex therebetween, the nub being in contact engagement with the first surface when the cap is at the first position and being slidable over the apex to reach and engage the second surface when the cap is moved from the first position to the second position whereby a pulse-like reaction is generated when the nub slides over the apex.

2. The pushbutton as claimed in claim 1, wherein a spring arm is formed on the base board and engages with one of the first and second side bars to bias the cap toward the first position.

3. The pushbutton as claimed in claim 2, wherein a first recess is formed on a free end of the spring arm, a second recess being defined in the side bar for receivingly engaging the first recess there attaching the free end of the spring arm to the side bar.

4. The pushbutton as claimed in claim 2, wherein the spring arm comprises an offset section formed on a free end thereof for being received in a recess defined in the side bar thereby attaching the free end of the spring arm to the side bar.

5. The pushbutton as claimed in claim 1, wherein the first link comprises two first side bars connected between the upper and lower pivots thereof, each first side bar defining a recess, two spring arms being formed on the base board and corresponding to the first side bars, each having a free end received in the recess of the corresponding first side bar.

6. The pushbutton as claimed in claim 1, wherein the first arm of the first link is resilient and the second arm of the second link is substantially rigid.

7. The pushbutton as claimed in claim 1, wherein the first link comprises two first side bars connected between the upper and lower links thereof, a cross bar connected between the first side bars with the first arm extending from the side bar, the nub being formed on a free end of the first arm for selectively engaging with one of the surfaces of the second arm.

8. The pushbutton as claimed in claim 1, wherein the first link comprises a U-shaped member having two first side bars and the second link comprises a rectangular frame received between the first side bars, the second link having two second side bars corresponding to the first side bars, each second side bar forming a transverse pin rotatably received in a hole defined in the corresponding first side bar thereby pivotally connecting the second link to the first link.

9. A pushbutton comprising a cap supported on a base board by a linkage, the linkage including first and second links pivoted to each other forming a cross configuration whereby the cap is movable with respect to the base board between a first position and a second position, each link having upper and lower pivots respectively connected to the cap and the base board, at least a spring arm extending from the base board and engaging with one of the first and second links to bias the cap toward the first position, the first link including two spaced side bars, the base board having two spring arms extending therefrom and respectively engaging the side bars.

10. The pushbutton as claimed in claim 9, wherein each spring arm has a free end forming an offset section receivingly engaging a recess defined in the corresponding side bar.

* * * * *